US010304592B1

(12) United States Patent
Hornung et al.

(10) Patent No.: US 10,304,592 B1
(45) Date of Patent: May 28, 2019

(54) ELECTRICAL CABLE

(71) Applicant: TE CONNECTIVITY CORPORATION, Berwyn, PA (US)

(72) Inventors: Craig Warren Hornung, Harrisburg, PA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/925,243

(22) Filed: Mar. 19, 2018

(51) Int. Cl.

| | |
|---|---|
| ***H01B 11/00*** | (2006.01) |
| ***H01R 13/6592*** | (2011.01) |
| ***H01B 7/17*** | (2006.01) |
| *H01B 11/10* | (2006.01) |

(52) U.S. Cl.
CPC ..... *H01B 11/002* (2013.01); *H01B 7/17* (2013.01); *H01R 13/6592* (2013.01); *H01B 11/1008* (2013.01)

(58) Field of Classification Search
CPC ..... H01B 11/002; H01B 7/17; H01R 13/6592
USPC ..... 174/350
See application file for complete search history.

(56) References Cited

U.S. PATENT DOCUMENTS

| | | | |
|---|---|---|---|
| 3,340,353 | A | 9/1967 | Mildner |
| 3,439,111 | A | 4/1969 | Miracle et al. |
| 4,221,926 | A | 9/1980 | Schneider |
| 4,596,897 | A | 6/1986 | Gruhn |
| 4,644,092 | A | 2/1987 | Gentry |
| 5,142,100 | A | 8/1992 | Vaupotic |
| 5,329,064 | A | 7/1994 | Tash et al. |
| 5,349,133 | A | 9/1994 | Rogers |
| 5,619,016 | A | 4/1997 | Newmoyer |
| 6,010,788 | A | 1/2000 | Kebabjian et al. |
| 6,403,887 | B1 | 6/2002 | Kebabjian et al. |
| 6,504,379 | B1 | 1/2003 | Jackson |
| 6,677,518 | B2 | 1/2004 | Hirakawa et al. |

(Continued)

FOREIGN PATENT DOCUMENTS

| | | |
|---|---|---|
| CN | 201327733 | 10/2009 |
| CN | 201359878 | 12/2009 |

(Continued)

OTHER PUBLICATIONS

Co-Pending U.S. Appl. No. 15/925,265 filed on Mar. 19,2018.

(Continued)

*Primary Examiner* — Timothy J Thompson
*Assistant Examiner* — Charles Pizzuto

(57) ABSTRACT

An electrical cable includes a conductor assembly having a first conductor, a second conductor and an insulator surrounding the first conductor and the second conductor. The conductor assembly extends along a longitudinal axis for a length of the electrical cable, along a lateral axis bisecting the first and second conductors, and along a transverse axis centered between the first and second conductors. The longitudinal axis, the lateral axis and the transverse axis are mutually perpendicular axes. The insulator has an outer surface. A cable shield is wrapped around the core having an inner edge and a flap covering the inner edge. The cable shield forms a void at the inner edge. The cable shield engages the outer surface entirely circumferentially around the insulator except at the void. The void is aligned with the transverse axis.

20 Claims, 2 Drawing Sheets

(56) References Cited

U.S. PATENT DOCUMENTS

| | | | | |
|---|---|---|---|---|
| 7,314,998 | B2 | 1/2008 | Amato et al. | |
| 7,790,981 | B2 | 9/2010 | Vaupotic et al. | |
| 7,827,678 | B2 | 11/2010 | Dion et al. | |
| 7,999,185 | B2 | 8/2011 | Cases et al. | |
| 8,378,217 | B2 | 2/2013 | Sugiyama et al. | |
| 8,381,397 | B2 | 2/2013 | Dion et al. | |
| 8,440,910 | B2 | 5/2013 | Nonen et al. | |
| 8,546,691 | B2 | 10/2013 | Watanabe et al. | |
| 8,552,291 | B2 | 10/2013 | Lingambudi et al. | |
| 8,575,488 | B2 | 11/2013 | Sugiyama et al. | |
| 8,674,228 | B2 | 3/2014 | Dion et al. | |
| 8,866,010 | B2 | 10/2014 | Nonen et al. | |
| 8,981,216 | B2 | 3/2015 | Grant et al. | |
| 8,993,883 | B2 | 3/2015 | Kumakura et al. | |
| 9,064,621 | B2 | 6/2015 | Kodama et al. | |
| 9,117,572 | B2 | 8/2015 | Fukasaku | |
| 9,123,452 | B2 | 9/2015 | Sugiyama et al. | |
| 9,123,457 | B2 | 9/2015 | Kaga et al. | |
| 9,136,042 | B2 | 9/2015 | Sugiyama et al. | |
| 9,142,333 | B2 | 9/2015 | Kaga et al. | |
| 9,159,472 | B2 | 10/2015 | Nordin et al. | |
| 9,214,260 | B2 | 12/2015 | Ishikawa et al. | |
| 9,299,481 | B2 | 3/2016 | Ishikawa et al. | |
| 9,349,508 | B2 | 5/2016 | Nonen et al. | |
| 9,350,571 | B2 * | 5/2016 | Watanabe | H04L 25/0272 |
| 9,466,408 | B2 | 10/2016 | Sugiyama | |
| 9,484,127 | B2 | 11/2016 | Sugiyama et al. | |
| 9,496,071 | B2 * | 11/2016 | Nagahashi | B60R 16/0215 |
| 9,548,143 | B2 | 1/2017 | Sugiyama et al. | |
| 9,583,235 | B2 | 2/2017 | Nonen et al. | |
| 9,660,318 | B2 | 5/2017 | Sugiyama et al. | |
| 2003/0150633 | A1 | 8/2003 | Hirakawa et al. | |
| 2006/0254801 | A1 * | 11/2006 | Stevens | H01B 11/1008 174/102 R |
| 2010/0307790 | A1 | 12/2010 | Okano | |
| 2011/0100682 | A1 | 5/2011 | Nonen et al. | |
| 2011/0127062 | A1 | 6/2011 | Cases et al. | |
| 2012/0024566 | A1 | 2/2012 | Shimosawa et al. | |
| 2012/0080211 | A1 | 4/2012 | Brown et al. | |
| 2012/0152589 | A1 | 6/2012 | Kumakura et al. | |
| 2012/0227998 | A1 | 9/2012 | Lindstrom et al. | |
| 2013/0175081 | A1 | 7/2013 | Watanabe et al. | |
| 2013/0333913 | A1 | 12/2013 | Nonen et al. | |
| 2014/0048302 | A1 | 2/2014 | Nonen et al. | |
| 2014/0102783 | A1 | 4/2014 | Nagahashi et al. | |
| 2014/0305676 | A1 | 10/2014 | Sugiyama et al. | |
| 2015/0000954 | A1 | 1/2015 | Nonen et al. | |
| 2015/0255928 | A1 | 9/2015 | Liptak et al. | |
| 2016/0111187 | A1 | 4/2016 | Kodama | |
| 2016/0155540 | A1 | 6/2016 | Matsuda et al. | |
| 2016/0300642 | A1 | 10/2016 | Kodama et al. | |
| 2016/0343474 | A1 | 11/2016 | Nichols | |
| 2016/0372235 | A1 | 12/2016 | Sugiyama et al. | |
| 2017/0103830 | A1 | 4/2017 | Dettmer et al. | |
| 2018/0096755 | A1 * | 4/2018 | Tsujino | H01B 11/1826 |

FOREIGN PATENT DOCUMENTS

| | | |
|---|---|---|
| CN | 102231303 | 11/2011 |
| CN | 203931605 | 11/2014 |
| CN | 105741965 | 7/2016 |
| JP | 2000040423 | 2/2000 |
| JP | 2001093357 | 4/2001 |
| JP | 2012009321 | 1/2012 |
| JP | 2012238468 | 12/2012 |
| JP | 2013038082 | 2/2013 |
| JP | 2013258009 | 12/2013 |
| JP | 2014038802 | 2/2014 |
| JP | 2014078339 | 5/2014 |
| JP | 2014099404 | 5/2014 |
| JP | 2014142247 | 8/2014 |
| JP | 2014154490 | 8/2014 |
| JP | 2014157709 | 8/2014 |
| JP | 2015076138 | 4/2015 |
| JP | 2015146298 | 8/2015 |
| JP | 2015204195 | 11/2015 |
| JP | 2015230836 | 12/2015 |
| JP | 2016015255 | 1/2016 |
| JP | 2016027547 | 2/2016 |
| JP | 2016072007 | 5/2016 |
| JP | 2016072196 | 5/2016 |
| JP | 2016110960 | 6/2016 |
| JP | 2016213111 | 12/2016 |
| WO | 96041351 | 12/1996 |

OTHER PUBLICATIONS

Co-Pending U.S. Appl. No. 15/969,264 filed on May 2, 2018.
Co-Pending U.S. Appl. No. 15/952,690 filed on Apr. 13, 2018.
Co-Pending U.S. Appl. No. 15/159,003 filed on Oct. 12, 2018.
Co-Pending U.S. Appl. No. 15/159,053 filed on Oct. 12, 2018.

* cited by examiner

ELECTRICAL CABLE

BACKGROUND OF THE INVENTION

The subject matter herein relates generally to signal transmission electrical cables and shielding efficiency for signal conductors.

Shielded electrical cables are used in high-speed data transmission applications in which electromagnetic interference (EMI) and/or radio frequency interference (RFI) are concerns. Electrical signals routed through shielded cables radiate less EMI/RFI emissions to the external environment than electrical signals routed through non-shielded cables. In addition, the electrical signals being transmitted through the shielded cables are better protected against interference from environmental sources of EMI/RFI than signals through non-shielded cables.

Shielded electrical cables are typically provided with a cable shield formed by a tape wrapped around the conductor assembly. Signal conductors are typically arranged in pairs conveying differential signals. The signal conductors are surrounded by an insulator and the cable shield is wrapped around the insulator. However, where the cable shield overlaps itself, an air void is created. The air void affects the electrical performance of the conductors in the electrical cable by changing the dielectric constant of the material near one of the conductors compared to the other of the conductors within the differential pair, leading to electrical signal timing skew.

A need remains for an electrical cable that improves signal performance.

BRIEF DESCRIPTION OF THE INVENTION

In an embodiment, an electrical cable is provided including a conductor assembly having a first conductor, a second conductor and an insulator surrounding the first conductor and the second conductor. The conductor assembly extends along a longitudinal axis for a length of the electrical cable, along a lateral axis bisecting the first and second conductors, and along a transverse axis centered between the first and second conductors. The longitudinal axis, the lateral axis and the transverse axis are mutually perpendicular axes. The insulator has an outer surface. A cable shield is wrapped around the core having an inner edge and a flap covering the inner edge. The cable shield forms a void at the inner edge. The cable shield engages the outer surface entirely circumferentially around the insulator except at the void. The void is aligned with the transverse axis.

In an exemplary embodiment, an electrical cable is provided including a conductor assembly having a first conductor, a second conductor and an insulator surrounding the first conductor and the second conductor. The conductor assembly extends along a longitudinal axis for a length of the electrical cable, along a lateral axis bisecting the first and second conductors, and along a transverse axis centered between the first and second conductors. The longitudinal axis, the lateral axis and the transverse axis are mutually perpendicular axes. The insulator has an outer surface. A cable shield is wrapped around the core. The cable shield has an inner edge and a flap covering the inner edge. The cable shield forms a void at the inner edge having a first portion proximate to the inner edge and a second portion remote from the inner edge. The first portion has a first volume and the second portion has a second volume approximately equal to the first volume. The first portion is located on a first side of the transverse axis and the second portion is located on a second side of the transverse axis.

In an exemplary embodiment, an electrical cable is provided including a conductor assembly having a first conductor, a second conductor and an insulator surrounding the first conductor and the second conductor. The first conductor has an inner end facing the second conductor and an outer end opposite the inner end. The conductor assembly extends along a longitudinal axis for a length of the electrical cable, a lateral axis bisecting the first and second conductors, and a transverse axis centered between the first and second conductors. The longitudinal axis, the lateral axis and the transverse axis are mutually perpendicular axes. The insulator has an outer surface. A cable shield wraps around the core. The cable shield has an inner edge and a flap covering the inner edge. The inner edge is positioned between a first tangent at the inner end of the first conductor and a second tangent at the outer end of the first conductor where the first and second tangents are parallel to the transverse axis. The cable shield forms a void at the inner edge extending along the outer surface toward the second conductor.

DETAILED DESCRIPTION OF THE INVENTION

Figure 1:
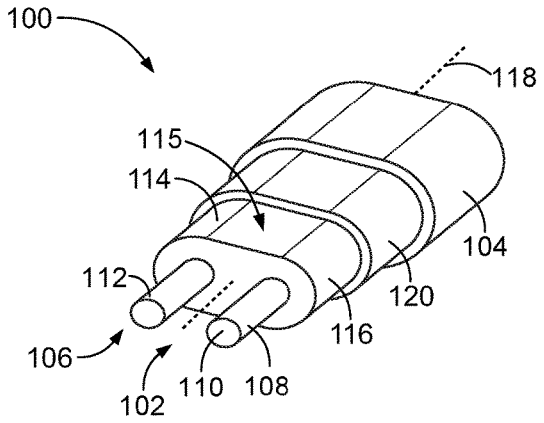
FIG. 1 is a perspective view of a portion of an electrical cable formed in accordance with an embodiment.

FIG. 1 is a perspective view of a portion of an electrical cable 100 formed in accordance with an embodiment. The electrical cable 100 may be used for high speed data transmission between two electrical devices, such as electrical switches, routers, and/or host bus adapters. For example, the electrical cable 100 may be configured to transmit data signals at speeds of at least 10 gigabits per second (Gbps), which is required by the enhanced small form-factor pluggable (SFP+) standard. For example, the electrical cable 100 may be used to provide a signal path between high speed connectors that transmit data signals at speeds between 10 and 30 Gbps, or more. It is appreciated, however, that the benefits and advantages of the subject matter described and/or illustrated herein may accrue equally to other data transmission rates and across a variety of systems and standards. In other words, the subject matter described and/or illustrated herein is not limited to data transmission rates of 10 Gbps or greater.

The electrical cable 100 includes a conductor assembly 102. The conductor assembly 102 is held within an outer jacket 104 of the electrical cable 100. In the illustrated embodiment, only one conductor assembly 102 is shown within the outer jacket 104. The outer jacket 104 surrounds the conductor assembly 102 along a length of the conductor assembly 102. In FIG. 1, the conductor assembly 102 is shown protruding from the outer jacket 104 for clarity in order to illustrate the various components of the conductor assembly 102 that would otherwise be obstructed by the outer jacket 104. It is recognized, however, that the outer jacket 104 may be stripped away from the conductor assembly 102 at a distal end 106 of the cable 100, for example, to allow for the conductor assembly 102 to terminate to an electrical connector, a printed circuit board, or the like.

The conductor assembly 102 includes inner conductors arranged in a pair 108 that are configured to convey data signals. In an exemplary embodiment, the pair 108 of conductors defines a differential pair conveying differential signals. The conductor assembly 102 includes a first conductor 110 and a second conductor 112. The conductor assembly 102 may be a twin-axial differential pair conductor assembly. In an exemplary embodiment, the conductor assembly 102 includes at least one insulator surrounding the conductors 110, 112. For example, the conductor assembly 102 includes a first insulator 114 and a second insulator 116 surrounding the first and second conductors 110, 112, respectively. In various embodiments, the first and second insulators 114, 116 are integral as parts of a monolithic, unitary insulator structure with the material of the insulator structure closer to the first conductor 110 defining the first insulator 114 and the material of the insulator structure closer to the second conductor 112 defining the second insulator 116. The insulator structure of the first and second insulators 114, 116 may be generally referred to as an insulator 115. In other various embodiments, the first and second insulators are separate, discrete components sandwiched together in the cable core of the electrical cable 100. The numerical designations, for example, "first," and "second," are used solely for identification purposes in order to describe the relative components of the conductor assemblies 102 of the cable 100.

The conductor assembly 102 includes a cable shield 120 surrounding the insulators 114, 116 and providing electrical shielding for the conductors 110, 112. In an exemplary embodiment, the conductors 110, 112 extend the length of the electrical cable 100 along a longitudinal axis 118. The cable shield 120 provides circumferential shielding around the pair 108 of conductors 110, 112 along the length of the electrical cable 100.

The conductors 110, 112 extend longitudinally along the length of the cable 100. The conductors 110, 112 are formed of a conductive material, for example a metal material, such as copper, aluminum, silver, or the like. Each conductor 110, 112 may be a solid conductor or alternatively may be composed of a combination of multiple strands wound together. The conductors 110, 112 extend generally parallel to one another along the length of the electrical cable 100.

The first and second insulators 114, 116 surround and engage outer perimeters of the corresponding first and second conductors 110, 112. As used herein, two components "engage" or are in "engagement" when there is direct physical contact between the two components. The insulators 114, 116 are formed of a dielectric material, for example one or more plastic materials, such as polyethylene, polypropylene, polytetrafluoroethylene, or the like. The insulators 114, 116 may be formed directly to the inner conductors 110, 112 by a molding process, such as extrusion, overmolding, injection molding, or the like. The insulators 114, 116 extend between the conductors 110, 112 and the cable shield 120. The insulators 114, 116 separate or space apart the conductors 110, 112 from one another and separate or space apart the conductors 110, 112 from the cable shield 120. The insulators 114, 116 maintain separation and positioning of the conductors 110, 112 along the length of the electrical cable 100. The insulators 114, 116 may be one integral insulator member that surrounds and engages both conductors 110, 112. Alternatively, the insulators 114, 116 may be two discrete insulator members that engage one another between the conductors 110, 112. The size and/or shape of the conductors 110, 112, the size and/or shape of the insulators 114, 116, and the relative positions of the conductors 110, 112 and the insulators 114, 116 may be modified or selected in order to attain a particular impedance for the electrical cable 100. For example, the conductors 110, 112 may be moved relatively closer or relatively further from each other to affect electrical characteristics of the electrical cable 100.

The cable shield 120 engages and surrounds outer perimeters of the insulators 114, 116. The cable shield 120 is formed, at least in part, of a conductive material. In an exemplary embodiment, the cable shield 120 is a tape configured to be wrapped around the cable core. For example, the cable shield 120 may include a multi-layer tape having a conductive layer and an insulating layer, such as a backing layer. The conductive layer and the backing layer may be secured together by adhesive. Optionally, the cable shield 120 may include an adhesive layer, such as along the interior side to secure the cable shield 120 to the insulators 114, 116 and/or itself. The conductive layer may be a conductive foil or another type of conductive layer. The insulating layer may be a polyethylene terephthalate (PET) film, or similar type of film. The conductive layer provides electrical shielding for the first and second conductors 110, 112 from external sources of EMI/RFI interference and/or to block cross-talk between other conductor assemblies 102 or electrical cables 100. In an exemplary embodiment, the electrical cable 100 includes a wrap or another layer around the cable shield 120 that holds the cable shield 120 on the insulators 114, 116. For example, the electrical cable 100 may include a helical wrap. The wrap may be a heat shrink wrap. The wrap is located inside the outer jacket 104.

The outer jacket 104 surrounds and engages the outer perimeter of the cable shield 120. In the illustrated embodiment, the outer jacket 104 engages the cable shield 120 along substantially the entire periphery of the cable shield 120. The outer jacket 104 is formed of at least one dielectric material, such as one or more plastics (for example, vinyl, polyvinyl chloride (PVC), acrylonitrile butadiene styrene (ABS), or the like). The outer jacket 104 is non-conductive, and is used to insulate the cable shield 120 from objects outside of the electrical cable 100. The outer jacket 104 also protects the cable shield 120 and the other internal components of the electrical cable 100 from mechanical forces, contaminants, and elements (such as fluctuating temperature and humidity). Optionally, the outer jacket 104 may be extruded or otherwise molded around the cable shield 120. Alternatively, the outer jacket 104 may be wrapped around the cable shield 120 or heat shrunk around the cable shield 120.

Figure 2:
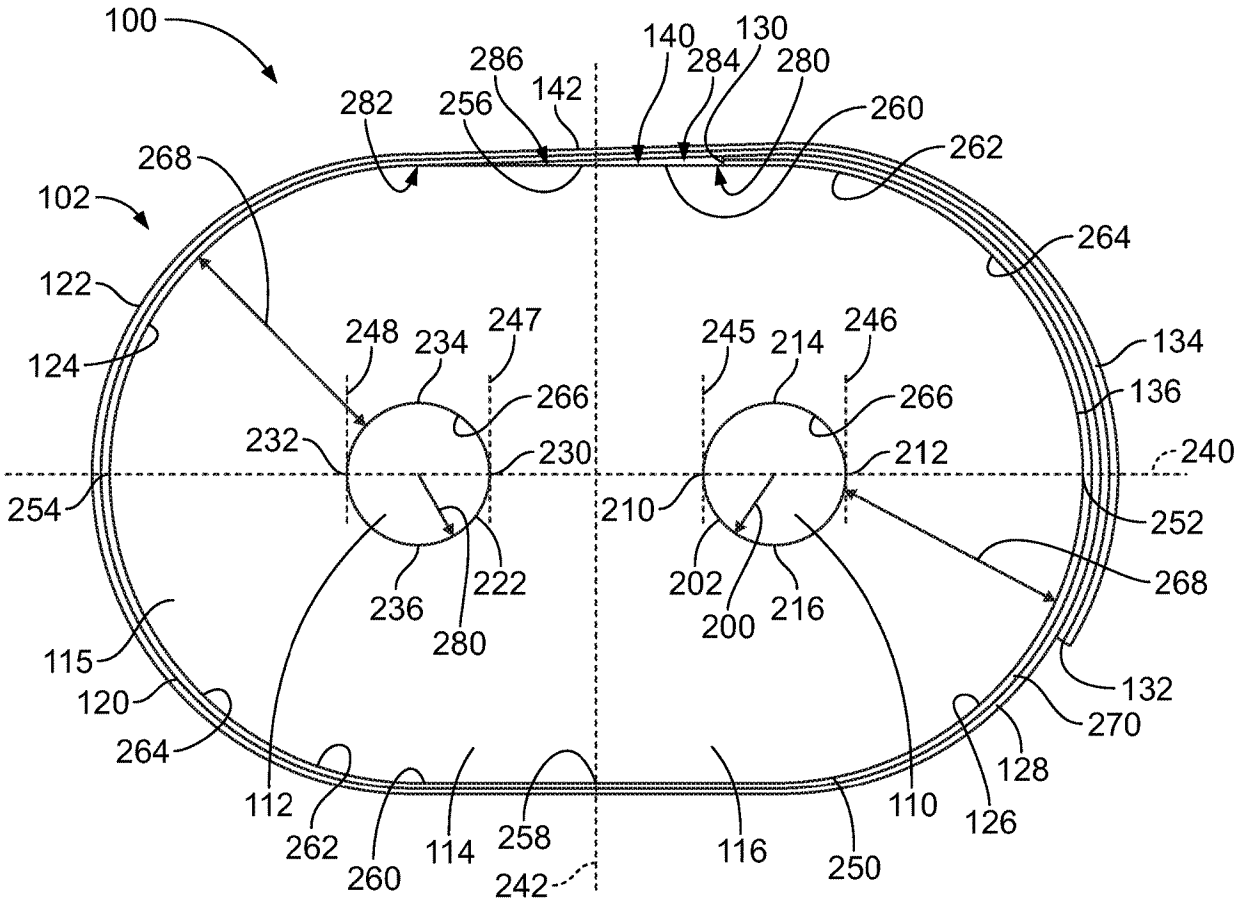
FIG. 2 is a cross-sectional view of the conductor assembly in accordance with an exemplary embodiment.

FIG. 2 is a cross-sectional view of the conductor assembly 102 in accordance with an exemplary embodiment. The cable shield 120 is wrapped around the first and second insulators 114, 116 in the cable core. The cable shield 120 includes a conductive layer 122 and an insulating layer 124. In the illustrated embodiment, the insulating layer 124 is provided on an interior 126 of the cable shield 120 and the conductive layer 122 is provided on an exterior 128 of the cable shield 120; however, the conductive layer 122 may be provided on the interior of the cable shield in alternative embodiments.

The cable shield 120 includes an inner edge 130 and an outer edge 132. When the cable shield 120 is wrapped around the cable core, a flap 134 of the cable shield 120 overlaps the inner edge 130 and a segment 136 of the cable shield 120. The interior 126 of the flap 134 may be secured to the exterior 128 of the segment 136 along a seam, such as using adhesive. The interior 126 of portions of the cable shield 120 may be secured directly to the first and second insulators 114, 116, such as using adhesive. When the cable shield 120 is wrapped over itself to form the flap 134, a void 140 is created. The cable shield 120 may be wrapped such that the flap 134 is at the top and wrapping to the right side as in the illustrated embodiment. However, the cable shield 120 may be wrapped in other directions in alternative embodiments. For example, the flap 134 may be at the top but wrap around the left side or the flap 134 and the void 140 may be located on the bottom of the cable core in other alternative embodiments.

The void 140 is created at the seam side of the electrical cable 100. In various embodiments, the void 140 is a pocket of air defined between the interior 126 of an elevated segment 142 of the cable shield 120 and the insulator 115. In other various embodiments, the void 140 may be filled with another material, such as adhesive or other dielectric material. The elevated segment 142 is elevated or lifted off of the insulator 115 to allow the flap 134 to clear the inner edge 130. The volume of the air in the void 140 affects the electrical characteristics of the conductors 110, 112 by changing the dielectric constant of the dielectric material between the conductive layer 122 of the cable shield 120 and the corresponding conductors 110, 112. While it may be desirable to reduce the volume of the void 140, the presence of the void 140 is inevitable when the electrical cable 100 is assembled due to the flap 134 overlapping the segment 136. In conventional electrical cables, the air in the void 140 leads to a skew imbalance for one of the conductors, such as the first conductor 110, because the void 140 is offset on one side or the other of the conductor assembly 102. The void in conventional electrical cables changes the dielectric constant of the dielectric material around the first conductor 110, compared to the second conductor 112, leading to skew imbalance. For example, signals transmitted by the first conductor 110 may be transmitted faster than the signals transmitted by the second conductor 112, leading to skew in the differential pair in conventional electrical cables.

In an exemplary embodiment, the electrical cable 100 is manufactured to reduce skew imbalance by locating the void 140 between the first and second conductors 110, 112. The location of the void 140 may be selected to completely balance the skew effects of the void 140 leading to a zero skew or near-zero skew effect. For example, the void 140 may be approximately centered between the first and second conductors 110, 112. Optionally, due to the shape of the void 140, the void 140 may be off-set from centered above the first and second conductors 110, 112, such as with the volumes of air in the void 140 being approximately centered between the first and second conductors 110, 112.

In an exemplary embodiment, the first conductor 110 has a circular cross-section having a first radius 200 to a first conductor outer surface 202 of the first conductor 110. The first conductor 110 has an inner end 210 facing the second conductor 112 and an outer end 212 opposite the inner end 210. The first conductor 110 has a first side 214 (for example, a top side) and a second side 216 (for example, a bottom side) opposite the first side 214. The first and second sides 214, 216 are equidistant from the inner and outer ends 210, 212.

In an exemplary embodiment, the second conductor 112 has a circular cross-section having a second radius 220 to a second conductor outer surface 222 of the second conductor 112. The second conductor 112 has an inner end 230 facing the first conductor 110 and an outer end 232 opposite the inner end 230. The second conductor 112 has a first side 234 (for example, a top side) and a second side 236 (for example, a bottom side) opposite the first side 234. The first and second sides 234, 236 are equidistant from the inner and outer ends 230, 232.

The conductor assembly 102 extends along a lateral axis 240 bisecting the first and second conductors 110, 112. Optionally, the lateral axis 240 may be centered in the insulator 115. The conductor assembly 102 extends along a transverse axis 242 centered between the first and second conductors 110, 112, such as centered between the inner ends 210, 230 of the first and second conductors 110, 112. Optionally, the transverse axis 242 may be centered in the insulator 115 with the first insulator 114 on the first side of the transverse axis 242 and with the second insulator 116 on the second side of the transverse axis 242. In an exemplary embodiment, the transverse axis 242 is located at the magnetic center of the cable core between the first and second conductors 110, 112. In an exemplary embodiment, the longitudinal axis 118 (shown in FIG. 1), the lateral axis 240 and the transverse axis 242 are mutually perpendicular axes. In an exemplary embodiment, the first conductor 110 has a first tangent 245 at the inner end 210 and a second tangent 246 at the outer end 212, both being parallel to the transverse axis 242. The second conductor 112 has a first tangent 247 at the inner end 230 and a second tangent 248 at the outer end 232, both being parallel to the transverse axis 242.

The insulator 115 has an outer surface 250. In an exemplary embodiment, the outer surface 250 has a generally elliptical or oval shape defined by a first end 252, a second end 254 opposite the first end 252, a first side 256 (for example, a top side) and a second side 258 (for example, a bottom side) opposite the first side 256. The first and second sides 256, 258 may have flat sections 260 and may have curved sections 262, such as at the transitions with the first and second ends 252, 254. The first and second ends 252, 254 have curved sections 264 that transition between the first and second sides 256, 258. The insulator 115 has inner surfaces 266 engaging the first and second conductors 110, 112. The material of the insulator 115 between the inner surfaces 266 and the outer surface 250 has a thickness. Optionally, the thickness may be uniform. Alternatively, the thickness may vary, such as being narrower at the first and second sides 256, 258 and being widest at the centroids of the first and second ends 252, 254.

The insulator thickness defines a shield distance 268 between the cable shield 120 and the corresponding conductor 110, 112. The shield distance 268 between the cable shield 120 and the conductors 110, 112 affects the electrical characteristics of the signals transmitted by the conductors 110, 112. For example, the shield distance 268 may affect the delay or skew of the signal, the insertion loss of the signal, the return loss of the signal, and the like. The dielectric material between the cable shield 120 and the corresponding conductors 110, 112 affects the electrical characteristics of the signals transmitted by the conductors 110, 112. For example, the presence or absence of the material of the insulator 115 affects the electrical characteristics and the presence or absence of the air in the void 140 affects the electrical characteristics. In an exemplary embodiment, having the void 140 present between the first conductor 110 and the cable shield 120 and having the void 140 present between the second conductor 112 and the cable shield 120 minimizes skew imbalance because the void 140 affects both signals in the conductors 110, 112, and may affect both signals equally for zero or near zero skew effects in the electrical cable 100. The void 140 is positioned to balance the dielectric constants associated with the first and second conductors 110, 112. For example, the void 140 introduces air in the vicinity of the first conductor 110 and introduces air in the vicinity of the second conductor 112, which has a different dielectric constant than the dielectric material of the insulator 115 and the position of the void 140 is selected to balance the dielectric constants around the first and second conductors 110, 112.

The cable shield 120 engages the outer surface 250 along an engaging segment 270 and is lifted off of the outer surface 250 along the elevated segment 142. In the illustrated embodiment, the engaging segment 270 extends circumferentially around a majority of the outer surface 250. For example, the engaging segment 270 may engage the first side 256 and/or the first end 252 and/or the second side 258 and/or the second end 254. In various embodiments, the engaging segment 270 may encompass more than 50% of the length of the outer surface 250. In some embodiments, the engaging segment 270 encompasses 75% or more of the length of the outer surface 250. In other various embodiments, the engaging segment 270 may encompass more than 90% of the length of the outer surface 250. In the illustrated embodiment, the elevated segment 142 extends along the first side 256. Optionally, the elevated segment 142 may extend along less than the entire first side 256 such that the engaging segment 270 extends along at least a portion of the first side 256. In various embodiments, the elevated segment 142 may encompass less than 30% of the length of the outer surface 250. In other various embodiments, the elevated segment 142 may encompass less than 10% of the length of the outer surface 250.

The void 140 is defined between the elevated segment 142 and the outer surface 250 of the insulator 115. The cable shield 120 engages the outer surface 250 on both sides of the elevated segment 142. The flap 134 wraps around a portion of the insulator 115, such as from the elevated segment 142 to the outer edge 132. Optionally, the outer edge 132 may be located along the second insulator 116, such as approximately aligned with the second end 254; however, the flap 134 may be located at other positions in alternative embodiments. The flap 134 provides electrical shielding at the inner edge 130.

The void 140 affects the electrical characteristics of the signals transmitted by the first conductor 110 and by the second conductor 112. For example, the void 140 may have a skew effect on the skew of the signals transmitted by the first conductor 110 and by the second conductor 112. The void 140 creates a first skew imbalance in the first conductor 110 and a second skew imbalance in the second conductor 112. In an exemplary embodiment, the void 140 is positioned between the first and second conductors 110, 112 to balance the first and second skew in balances on the first and second conductors 110, 112, respectively. The void 140 changes the dielectric constant of the material surrounding the first conductor 110 by introducing air in the shield space and the void 140 changes the dielectric constant of the material surrounding the second conductor 112 by introducing air in the shield space. By introducing a material having a lower dielectric constant in the shield space, the electrical characteristics of the first and second conductors 110, 112 are affected.

The void 140 extends between a first end 280 and a second end 282. The first end 280 is provided at the inner edge 130 of the cable shield 120. The second end 282 is located remote from the inner edge 130 of the cable shield 120. The elevated segment 142 extends between the first end 280 and the second end 282. The lift off point of the elevated segment 142 is at the second end 282. The thickness of the cable shield 120 at the inner edge 130 affects the size and shape of the void 140, such as by affecting the height and the width of the void 140. In the illustrated embodiment, the void 140 is generally triangular shaped being tallest (for example, having a maximum height) off of the outer surface 250 at the inner edge 130 (first end 280) and tapering down toward zero height at the lift off point of the elevated segment 142 (second end 282).

The void 140 has a first portion 284 proximate to the first end 280 and a second portion 286 proximate to the second end 282. In various embodiments, the first portion 284 is shaped differently than the second portion 286. For example, because the void 140 has a triangular shape, the first portion 284 may be generally trapezoidal shaped and the second portion 286 may be generally triangular shaped; however, the first portion 284 and/or the second portion 286 may have other shapes in alternative embodiments. Optionally, the first portion 284 and the second portion 286 may have generally equal volumes. For example, the second portion 286 may be wider and shorter while the first portion 284 may be narrower and taller but having similar or equal volumes. In an exemplary embodiment, the void 140 is aligned with the transverse axis 242. For example, the void 140 spans along a portion of the first side 256 to the left of the transverse axis 242 and the void 140 spans along a portion of the first side 256 to the right of the transverse axis 242. In an exemplary embodiment, the void 140 is aligned with the transverse axis 242 such that the first portion 284 is to a first side of the transverse axis 242 and the second portion 286 is to a second side of the transverse axis 242. In various embodiments, the inner edge 130 is located at an angle of less than 45° (on either side, for example, +/−) from the transverse axis 242. In an exemplary embodiment, the inner edge 130 is located at an angle of less than 30° (+/−) from the transverse axis 242. In the illustrated embodiment, the inner edge 130 is located at an angle of approximately 20° (+/−) from the transverse axis. The angle may be a function of the thickness of the cable shield 120, which affects the size of the void 140. The angle may be a function of the thickness of the insulator 115. In an exemplary embodiment, the inner edge 130 is located along the flat section 260 of the first side 256, prior to the curved section 262. However, other locations for the inner edge 130 are possible in alternative embodiments.

In an exemplary embodiment, the void 140 is located between the first and second conductors 110, 112. For example, the void 140 is located interior of the outer end 212 (for example, interior of the second tangent 246) of the first conductor 110 and interior of the outer end 232 (for example, interior of the second tangent 248) of the second conductor 110. In an exemplary embodiment, the void 140 spans along at least a segment of the first conductor 110 and the void 140 spans along at least a segment of the second conductor 112. For example, the first end 280 of the void 140 is located between the inner end 210 and the outer end 212 and the second end 282 of the void 140 is located between the inner end 230 and the outer end 232. In the illustrated embodiment, the first end 280 of the void 140 is positioned between the first and second tangents 245, 246 of the first conductor 110 and the second end 282 of the void 140 may be positioned between the first and second tangents 247, 248 of the second conductor 112. However, in alternative embodiments, the void 140 does not span along the first conductor 110 and/or the second conductor. For example, the first end 280 of the void 140 may be positioned interior of the first tangent 245 of the first conductor 110 and/or the second end 282 of the void may be positioned interior of the first tangent 247 of the second conductor 112.

Optionally, the void 140 may span along a longer segment of the second conductor 112 than the first conductor 110. For example, in the illustrated embodiment, the first end 280 is positioned closer to the first tangent 245 than the second tangent 246 while the second end 282 is positioned closer to the second tangent 248 than the first tangent 247. Optionally, the void 140 may be approximately centered on the transverse axis 242. In an exemplary embodiment, the void 140 has an approximately equal volume of air on a first side of the transverse axis 242 as on a second side of the transverse axis 242. The void 140 is aligned between the first and second conductors 110, 112 to balance skew induced on the first and second conductors 110, 112 by the inclusion of the void 140 in the electrical cable 100. In various embodiments, the position of the void 140 is based on the shape of the cable shield 120, and thus the shield distance from the first and second conductors 110, 112.

The void 140 is positioned relative to the first and second conductors 110, 112 to balance or correct for any skew imbalance. The position of the void 140 may be selected to allow for a zero skew or near-zero skew in the conductor assembly 102. The positioning of the void 140 (for example, right-to-left positioning) may be selected based on the shape of the void 140, such as due to the thickness of the cable shield 120 and the effect of wrapping the flap 134 around the segment 136. In various embodiments, the volume of air in the first portion 284 and the volume of air in the second portion 286 are generally equal to speed up the signal transmission in the first conductor 110 and the second conductor 112 by the same amount to balance the skew.

Figure 3:
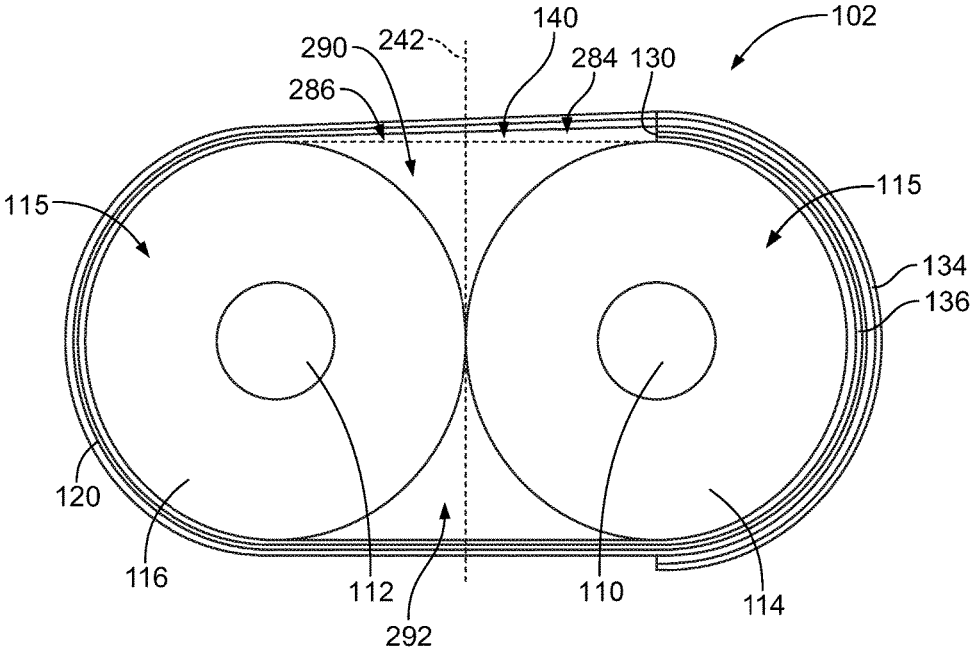
FIG. 3 is a cross-sectional view of the conductor assembly in accordance with an exemplary embodiment.

FIG. 3 is a cross-sectional view of the conductor assembly 102 according to another exemplary embodiment. In the alternative embodiment shown in FIG. 3, the insulator structure is defined by separate and discrete first and second insulators 114, 116. The outer perimeter of the insulator structure has a generally lemniscate or figure-eight shape, due to the combination of the two circular or elliptical insulators 114, 116. In the cable core, the conductor assembly 102 includes an upper pocket 290 and a lower pocket 292 defined by the shapes of the first and second insulators 114, 116 meeting and the center of the cable core.

In an exemplary embodiment, the cable shield 120 is coupled to the first and second insulators 114, 116 such that the cable shield 120 wraps around both of the first and second insulators 114, 116. The cable shield 120 has an oval shape similar to the shape of the cable shield 120 shown in FIG. 2. The inner edge 130 of the cable shield 120 is attached to the first insulator 114 and the flap 134 extends along the segment 136 in a similar manner as shown in FIG. 2. The cable shield 120 forms the void 140 above the upper pocket 290. For example, the shape of the void 140 and the upper pocket 290 is asymmetrical compared to the shape of the lower pocket 292. The void 140 is centered between the first and second conductors 110, 112 such that the volume of air (or other dielectric material) introduced by the first portion 284 and the second portion 286 of the void 140 into the upper pocket 290 is approximately equal and offsetting to balance the skew in the first and second conductors 110, 112. For example, the void 140 may be approximately centered along the transverse axis 242. In an exemplary embodiment, the void 140 is shifted slightly off center, such as to the left, such that an equal volume of air is provided to the left of the transverse axis 242 and to the right of the transverse axis 242 for skew balancing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical cable comprising:

a conductor assembly having a first conductor, a second conductor and an insulator surrounding the first conductor and the second conductor, the conductor assembly extending along a longitudinal axis for a length of the electrical cable, the conductor assembly extending along a lateral axis bisecting the first and second conductors, the conductor assembly extending along a transverse axis centered between the first and second conductors, the longitudinal axis, the lateral axis and the transverse axis being mutually perpendicular axes, the insulator having an outer surface; and a cable shield wrapped around the conductor assembly, the cable shield having an inner edge and a flap covering the inner edge, the cable shield forming a void at the inner edge, the cable shield engaging the outer surface entirely circumferentially around the insulator except at the void, the void being aligned with the transverse axis.

2. The electrical cable of claim 1, wherein the void spans along at least a segment of the first conductor and at least a segment of the second conductor.

3. The electrical cable of claim 2, wherein the void spans along a longer segment of the second conductor than the first conductor.

4. The electrical cable of claim 1, wherein the void is aligned between the first and second conductors to balance skew induced in the first and second conductors by the inclusion of the void.

5. The electrical cable of claim 1, wherein the void is triangular in cross section being tallest off of the outer surface at the inner edge.

6. The electrical cable of claim 1, wherein the void includes a first portion and a second portion having approximately equal volumes, the first portion being located on a first side of the transverse axis, the second portion being located on a second side of the transverse axis.

7. The electrical cable of claim 1, wherein the void is approximately centered on the transverse axis.

8. The electrical cable of claim 1, wherein the void extends between a first end at the inner edge and a second end remote from the first end, the cable shield lifting off of the outer surface at the second end, an inner surface of the cable shield engaging an outer surface of the cable shield at the first end.

9. The electrical cable of claim 1, wherein the cable shield is a tape having a shield layer and a dielectric layer, the tape extending between the inner edge and an outer edge at a distal end of the flap, the inner edge being located interior of the flap.

10. The electrical cable of claim 1, wherein the cable shield includes an engaging segment engaging the outer surface of the insulator and an elevated segment between the engaging segment and the flap, the elevated segment does not engage the outer surface of the insulator, the void being defined between the elevated segment and the outer surface of the insulator.

11. The electrical cable of claim 1, wherein the first conductor has an inner end facing the second conductor and an outer end opposite the inner end, the second conductor having an inner end facing the first conductor and an outer end opposite the inner end, the void extending between a first end at the inner edge and a second end, the first end and the second end of the void being located between the outer end of the first conductor and the outer end of the second conductor.

12. The electrical cable of claim 1, wherein the first conductor has an inner end facing the second conductor and an outer end opposite the inner end, the second conductor having an inner end facing the first conductor and an outer end opposite the inner end, the void extending between a first end at the inner edge and a second end, the first end being located between the inner end and the outer end of the first conductor, the second end being located between the inner end and the outer end of the second conductor.

13. The electrical cable of claim 1, wherein the inner edge is located at an angle of between +30° and −30° from the transverse axis.

14. An electrical cable comprising:

a conductor assembly having a first conductor, a second conductor and an insulator surrounding the first conductor and the second conductor, the conductor assembly extending along a longitudinal axis for a length of the electrical cable, the conductor assembly extending along a lateral axis bisecting the first and second conductors, the conductor assembly extending along a transverse axis centered between the first and second conductors, the longitudinal axis, the lateral axis and the transverse axis being mutually perpendicular axes, the insulator having an outer surface; and a cable shield wrapped around the conductor assembly, the cable shield having an inner edge and a flap covering the inner edge, the cable shield forming a void at the inner edge, the void having a first portion proximate to the inner edge and a second portion remote from the inner edge, the first portion having a first volume, the second portion having a second volume approximately equal to the first volume, the first portion being located on a first side of the transverse axis, the second portion being located on a second side of the transverse axis.

15. The electrical cable of claim 14, wherein the void spans along at least a portion of the first conductor and at least a portion of the second conductor.

16. The electrical cable of claim 14, wherein the void is aligned between the first and second conductors to balance skew induced by the first portion in the first conductor and induced by the second portion in the second conductor.

17. The electrical cable of claim 14, wherein the void is approximately centered on the transverse axis.

18. The electrical cable of claim 14, wherein the first conductor has an inner end facing the second conductor and an outer end opposite the inner end, the second conductor having an inner end facing the first conductor and an outer end opposite the inner end, the void extending between a first end at the inner edge and a second end, the first end and the second end of the void being located between the outer end of the first conductor and the outer end of the second conductor.

19. The electrical cable of claim 14, wherein the cable shield includes an engaging section engaging the outer surface of the insulator and a free section between the engaging section and the flap, the free section not engaging the outer surface of the insulator, the void being defined between the free section and the outer surface of the insulator.

20. An electrical cable comprising:

a conductor assembly having a first conductor, a second conductor and an insulator surrounding the first conductor and the second conductor, the first conductor having an inner end facing the second conductor and an outer end opposite the inner end, the conductor assembly extending along a longitudinal axis for a length of the electrical cable, the conductor assembly extending along a lateral axis bisecting the first and second conductors, the conductor assembly extending along a transverse axis centered between the first and second conductors, the longitudinal axis, the lateral axis and the transverse axis being mutually perpendicular axes, the insulator having an outer surface; and a cable shield wrapped around the conductor assembly, the cable shield having an inner edge and a flap covering the inner edge, the inner edge being positioned between a first tangent at the inner end of the first conductor and a second tangent at the outer end of the first conductor, the first and second tangents being parallel to the transverse axis, the cable shield forming an void at the inner edge extending along the outer surface toward the second conductor.

* * * * *